US005167919A

United States Patent [19]

Wagner

[11] Patent Number: 5,167,919

[45] Date of Patent: Dec. 1, 1992

[54] WASTE TREATMENT AND METAL REACTANT ALLOY COMPOSITION

[76] Inventor: Anthony S. Wagner, 13709 Hwy. 71 West, Bee Caves, Tex. 78738-3112

[21] Appl. No.: 669,756

[22] Filed: Mar. 15, 1990

Related U.S. Application Data

[63] Continuation-in-part of Ser. No. 524,278, May 16, 1990, Pat. No. 5,000,101.

[51] Int. Cl.[5] ..... C22C 21/12; C22C 21/00

[52] U.S. Cl. ..... 420/538; 420/582

[58] Field of Search ..... 420/582, 538, 540, 554

[56] References Cited

FOREIGN PATENT DOCUMENTS

| | | | |
|---|---|---|---|
| 263158 | 2/1970 | U.S.S.R. | 420/540 |
| 834192 | 6/1981 | U.S.S.R. | 420/582 |
| 1106845 | 8/1984 | U.S.S.R. | 420/582 |

*Primary Examiner*—Deborah Yee

*Attorney, Agent, or Firm*—Joseph F. Long

[57] ABSTRACT

An alloy composition of aluminum, zinc, iron, copper, and calcium when held molten at about 800 degrees C. by induction heating is capable of complete destruction of organic compounds that may be liquid or associated with sludges and at the same time is capable of reacting with metallic compounds in the sludges or liquid wastes to either dissolve or render the metals non-leachable.

3 Claims, No Drawings

WASTE TREATMENT AND METAL REACTANT ALLOY COMPOSITION

This application is a continuation-in-part of Ser. No. 524,278, filed May 16, 1990, now U.S. Pat. No. 5,000,101 entitled "A Hazardous Waste Reclamation Process." In Ser. No. 524,278 we described a similar alloy for use in converting toxic wastes to harmless products, essentially metallic salts, free carbon and hydrogen.

BACKGROUND

We have found that an alloy composition that when held molten by heating with an induction heater will react with wastes to render the resultant product land fillable by simultaneous reaction with both heavy oily sludge, metals, toxic chemical or biological materials using surface contact of these materials with the molten metallic alloy composition. The same alloy composition may also be used for destruction of liquid or gaseous organic wastes.

One alloy composition for general use comprises: 40-95% aluminum, 1-25% iron, 1-25% copper, 1-25% zinc and 1-25% calcium.

The percentages in the alloy composition may be varied if large quantities of one type of waste or metal containing waste is being treated. If large quantities of a particular waste such as chlorinated hydrocarbons only are being treated it may be necessary to replenish the calcium in the alloy composition and it is convenient to use a larger proportion of calcium in the starting mix. Compositions may be varied but aluminum, iron, zinc, copper and calcium were chosen to form lowest energy level salts from decomposition of a variety of different hazardous or toxic waste streams containing:

Group I—Anions of fluorine, bromine, chlorine or Iodine;

Group II—Sulfides as well as combinations of halogens and sulfides;

Group III—Phosphates alone or bonded to hydrocarbons or with complex molecules also containing halogens;

Group IV—Complex anions such as phosphochlorides, chlorosulfides, halogenated oxides, dioxane, furans and hazardous compounds as listed in RECRA, Resource Conservation and Recovery Act.

Group V—Organic wastes such as leather, paper, or cloth.

Group VI—Organometal compounds.

The alloy chosen by this method comprises aluminum, copper, iron, calcium and zinc.

One preferred composition is 52% aluminum, 12% copper, 12% iron, 12% calcium and 12% zinc. These metals form a molten mass at about 800 degrees C. Depending upon particular waste being treated the percentage of any of these metals in the alloy could be changed markedly. The percentages have been chosen to achieve essentially complete destruction of hazardous wastes wherein the molecules may contain phosphines, cyanides, metals, halides, carbon, hydrogen, oxygen, nitrogen, etc., to form activated carbon, hydrogen, water, metal oxides, and metal salts.

We have found that there is a commercial need for reduction or elimination of organic compounds along with transition of metal compounds to a non-leachable form. A variety of commercially produced sludges such as filter cake, dewatered thickened solids etc., from refiner wastes have been treated with this alloy.

When lowest energy level salts are formed with this alloy, some metals or metal salts being treated dissolve in the alloy composition and may be removed and sold as a high grade ore. Other metal compounds such as chromium and nickle have been rendered non-leachable.

With the alloy composition held molten at 800 degrees C. by an induction heater samples of a sludge containing approximately 4% of a mixture of the following organic compounds: Acenaphthene, Anthracene, Benzene, Benzo (a) pyrene, Benzo (a) athracene, Bis (2-ethylhexyl) phthalate, Carbon disulfide, Chrysene, Di-n-butyl phthalate, 2 4 dimenthylphenol, Ethyl benzene, Fluorene, Naphthalene, Phenanthrene, Phenol, Pyrene, Toluene, O-cresol, Xylene and approximately 200 ppm chromium, 900 ppm lead, about 25 percent water and remainder a silicous material was contacted by surface mixing on the molten alloy. After alloy contact the remaining solids contained from less than 0.05 to 0.18 ppm leachable nickel and from 0.05 to 0.06 ppm leachable chromium. All of the organic compounds were destroyed to the extent that analysis of treated sludge remaining contained less than 1 ppm of each of the organics.

Liquid wastes such as PCB (polychlorinated biphenyl) when contacted with the alloy held molten at about 800 degrees C. by an induction heater and in the absence of air were completely destroyed leaving only activated carbon that was scrubbed out of effluent gas and metal salts in the alloy.

We have considered the following patents in the prior art:

| Patent No. | Inventor | Date |
|---|---|---|
| 4,552,667 | C. G. Shultz | 11/12/1985 |
| 4,666,696 | C. G. Shultz | 5/19/1987 |
| 4,526,677 | Leroy F. Grantham et al | 7/2/1985 |
| 4,497,782 | Samuel G. Howell et al | 2/5/1985 |
| 4,592,844 | Robert G. Layman et al | 6/3/1986 |
| 4,601,817 | Alfred R. Globus | 7/22/1986 |
| 4,581,130 | Alfred R. Globus | 4/8/1986 |
| 4,547,620 | Shigeo Miyata et al | 10/15/1985 |
| 4,435,779 | Robert S. Olson et al | 3/6/1984 |
| 4,246,255 | Leroy F. Grantham et al | 1/20/1981 |
| 4,469,661 | Clifford G. Shultz | 9/4/1984 |

The following of these were most closely related but markedly different than the subject invention:

U.S. Pat. No. 4,666,696 to Shultz describes destruction of nerve gas by contacting the vapor with a molten aluminum both at about 780 degrees-1000 degrees C.

U.S. Pat. No. 4,552,667 to Shultz describes a process to react organic wastes containing covalently bound oxygen, nitrogen, sulfer, and/or phosphorus with molten aluminum by feeding the waste into a molten aluminum bath with a vertical screw conveyor.

U.S. Pat. No. 4,526,677 describes destruction of polyhalogenated biphenyls absorbed on a combustible material by feeding air and the PCB in the combustible material into a molten alkali salt bath.

U.S. Pat. No. 4,497,782 describes destruction of toxic organic chemicals by contacting and reacting with a molten mixture of alkali metal.

U.S. Pat. No. 4,435,779 to Olsen et al describes use of metal oxides at elevated temperature for treating chlorinated hydrocarbons. Titanium dioxide and aluminum oxide were preferred.

U.S. Pat. No. 246,255 to Grantham et al describes decomposition of PCB (polychlorinated biphenyl) by feeding the PCB into a molten salt comprising sodium carbonate and sodium sulfate at 700–1000 degrees in the presence of air.

U.S. Pat. No. 4,469,661 to Shultz describes destruction of PCB and other halogenated hydrocarbons by contacting the PCB vapor with molten metallic aluminum. Lines 59 through 66, page 2, read as follows: "A low boiling eutectic mixture of aluminum and zinc or aluminum, zinc and magnesium; or eutectic mixtures containing iron, calcium or other heated metals would be expected to give equivalent results with exception of composition of end products. Aluminum is preferred due to its low melting point, reactivity, ready availability and low cost." In the process as described by Shultz, he mentions alkali metals for reaction with halogenated hydrocarbons and compares use of sodium in place of aluminum because of ease of handling and volatility of the anhydrous aluminum chloride salt. His process as claimed outlines solvent extraction of contaminated solids and destruction of the solvent extract by vaporizing and feeding into a molten bath. Among the significant differences from the alloy composition of our disclosure are the following:

1. We prefer to hold the liberated chlorine in the form of a salt which would be formed with calcium, zinc, magnesium, etc.

2. The five elements, aluminum, calcium, zinc, copper and iron, of our composition, were chosen from theoretical calculations to form the lowest energy level salts from essentially all common hazardous compounds.

3. Our composition is chosen not to form a low boiling eutectic, but to be molten at about 800 degrees C. when heated by an induction heater.

4. Our composition, when held molten at about 800 degrees C. by an induction heater, is sufficiently reactive that sludges containing significant levels of organic compounds and metals may be surface contacted to reacte with metals and organic compounds and resultant carbonaceous or silicious material is land fillable in a hazardous waste landfill. Many sludges previously banned for land disposal by Resources Conservation and Recovery Act may be treated to be land fillable in this way. Water in the solid being treated is quickly evaporated at about 800 degrees C.

BRIEF SUMMARY OF THE INVENTION

An alloy composition of aluminum, iron, copper, calcium and zinc formed by induction heating a mixture comprising 40–95 percent by weight aluminum, 1–25 percent by weight of copper, 1–25 percent by weight of iron, 1–25 percent by weight of calcium, and 1–25 percent by weight of zinc to approximately 800 degrees C. to form a molten mass destroys organic compounds and reacts with metals from wastes.

The elements of the alloy were chosen by theoretical calculations to form the lowest energy level salts from a) anions of fluorine, bromine, chlorine or iodine; b) sulfides or combinations of sulfides and halogens; c) phosphates, either along or bonded to hydrocarbons or in complex molecules containing halogens; d) complex anions such as phosphochlorides, chlorosulfides, halogenated oxides, dioxane, furous and hazardous compounds as listed in RECRA, Resources Conservation and Recovery Act; e) organometal compounds.

Theoretical calculations indicated that excitation of molecules by induction heating contributes to complete destruction of organic wastes. At the same time, metals from the wastes are reacted and dissolved or rendered non-leachable by the alloy.

The presence of 0.002 percent of platinum or less in the alloy may enhance the reactivity.

DESCRIPTION OF THE INVENTION

An alloy comprising 40–95% aluminum, 1–25% iron, 1–25% calcium, 1–25% copper, 1–25% zinc is formed by putting pellets of the listed metals into a ceramic bodied reactor and heating externally with an induction heater to form a molten mass at about 800 degrees C.

A preferred embodiment of the alloy comprises 52% aluminum and 12% each of iron, calcium, copper and zinc. Magnesium could be substituted for calcium but has no advantage. This alloy composition forms lowest energy level salts from wastes brought into contact with the alloy when the alloy is heated by an induction heater to about 800 degrees C.

Normally the alloy will be used for waste destruction with oxygen essentially held at very low levels by purging the reactor with an inert gas as the waste is contacted with the alloy held molten by induction heating.

The elements of the alloy were chosen by theoretical calculations to form the lowest energy level salts from a) anions of fluorine, bromine, chlorine or iodine; b) sulfides or combinations of sulfides and halogens; c) phosphates, either along or bonded to hydrocarbons or in complex molecules containing halogens; d) complex anions such as phosphochlorides, chlorosulfides, halogenated oxides, dioxane, furous and hazardous compounds as listed in RECRA, Resources Conservation and Recovery Act; e) organometal compounds.

Theoretical calculations also indicated that excitation of molecules by induction heating contributes to complete destruction of organic wastes.

The presence of approximately 0.002 percent of platinum or less in the alloy may enhance the reactivity.

What is claimed is:

1. An alloy composition for organic compound degradation and metal reaction comprising:

a) between about 40 to 95 percent by weight of aluminum;

b) between about 1 to 25 percent by weight of copper;

c) between about 1 to 25 percent by weight of iron;

d) between about 1 to 25 percent by weight of calcium;

e) between about 1 to 25 percent by weight of zinc;

said alloy composition reacting when held in a molten state by induction heating to disintegrate organic compounds and react with metallic compounds.

2. An alloy composition for organic compound degradation and metal reaction comprising:

a) about 52 percent by weight of aluminum;

b) about 12 percent by weight of copper;

c) about 12 percent by weight of iron;

d) about 12 percent by weight of calcium;

e) about 12 percent by weight of zinc.

3. An alloy composition for organic compound degradation and metal reaction as in claim 2 wherein reactivity of said alloy composition is enhanced when held in contact with platinum metal.

* * * * *